US005320543A

United States Patent [19]

Barton

[11] Patent Number: 5,320,543

[45] Date of Patent: Jun. 14, 1994

[54] FLEXIBLE PLUG PROTECTOR

[76] Inventor: Craig S. Barton, 3302 E. Topeka Dr., Phoenix, Ariz. 85024

[21] Appl. No.: 83,655

[22] Filed: Jun. 28, 1993

Related U.S. Application Data

[63] Continuation-in-part of Ser. No. 4,424, Feb. 4, 1993.

[51] Int. Cl.[5] ..... H01R 13/00

[52] U.S. Cl. ..... 439/148

[58] Field of Search ..... 439/135, 136, 142, 148

[56] References Cited

U.S. PATENT DOCUMENTS

| | | | |
|---|---|---|---|
| 2,559,151 | 7/1951 | Getzoff | 173/330 |
| 2,932,811 | 4/1960 | Abraham | 339/38 |
| 3,386,071 | 5/1968 | Allen | 339/36 |
| 3,389,367 | 6/1968 | Schwartz | 439/148 |
| 4,618,740 | 10/1986 | Ray et al. | 439/148 |
| 4,671,587 | 6/1987 | Lerner et al. | 439/142 |
| 4,743,206 | 5/1988 | Imhoff | 439/137 |
| 5,009,610 | 4/1991 | Woskow | 439/142 |
| 5,017,148 | 5/1991 | Birckshaw | 439/148 |
| 5,080,599 | 1/1992 | Wimberley | 439/148 |

*Primary Examiner*—Joseph H. McGlynn
*Attorney, Agent, or Firm*—Charles E. Cates; Frank T. Barber

[57] ABSTRACT

A duplex plug for protecting conventional duplex electrical outlets, has dielectric caps connected by a flexible, generally S-shaped tether. Each cap has projecting prongs that fit the outlet receptacle, and the tether may have an aperture for deteachably securing it to a center mounting hole of the electrical outlet by means of a mounting screw. Use of the center mounting hole attachment is optional. The length and shape of the S-shaped tether are adapted to permit convenient biasing of a cap laterally away from one electrical receptacle.

3 Claims, 1 Drawing Sheet

FLEXIBLE PLUG PROTECTOR

This application is a continuation-in-part of a copending U.S. design application No. 29/004,424 filed Feb. 4, 1993.

FIELD OF THE INVENTION

This invention generally relates to a flexible duplex plug protector having two plugs attached by a tether for duplex electrical outlets having a center mounting hole (for attachment of a decorative plate), and more particularly to a plug protector that permits the use of either one or both of the outlet receptacles while the plug protector is either attached to the outlet, by means of the tether and a screw in the center mounting or by one of the caps or solely by means of one only.

BACKGROUND OF THE INVENTION

Curious children attracted to electrical outlets are at risk of shock and injury resulting from touching live contacts or inserting metal objects into plug holes of electrical outlet receptacles. The prior art includes several types of protectors or guards to prevent the accidental or inadvertent insertion of fingers or metallic objects into the receptacle openings of electrical outlets. One such device is an electrically non-conducting dummy plug which can be inserted into the outlet receptacle when the receptacle is not in use. A short-coming of such a device is that it has no means to attach the dummy plug to the outlet when the dummy plug is not in use. A significant disadvantage of such a device is that when not in use, the dummy plug may become lost, misplaced, or broken.

A safety cover comprising a pair of safety plugs connected by a tether is disclosed by Buckshaw, U.S. Pat. No. 5,017,148 issued May 21, 1991. Buckshaw describes a flexible, linear tether having an aperture therein between the two safety plugs so that the tether can be attached to an electrical outlet by a screw. When a safety plug is not in use it is folded away from the receptacle and over the tether exposing an electrical outlet socket. While the Buckshaw apparatus keeps the safety cover in place when not in use, access to the outlet receptacle is crowded or obstructed by the close proximity of the unused safety plug in combination with the tether.

Accordingly, it is an object of this invention to provide a safety plug for protecting conventional duplex electrical outlets that is simple in structure, easy to use, and economical to produce.

Another object of the invention is to provide a safety plug which can be removably attached to conventional duplex electrical outlets without altering or modifying the structure of the outlet.

Another object of this invention is to provide a safety plug that can be quickly and easily employed to protect an outlet receptacle, and easily disengaged when access to the electrical outlet receptacle is desired.

A further object of the invention is to provide a duplex safety plug for a duplex electrical outlet that permits the use of either one or both of the outlet receptacles while the safety plug is still attached to the outlet, whether by means of one of the plugs or by means of the tether attached to the center mount.

Yet another object of the present invention is to provide a safety plug protector that can be quickly and easily placed on a conventional duplex electrical outlet to cover and seal it during painting, and then be easily removed after the painting has been completed.

BRIEF SUMMARY OF THE INVENTION

The present invention is a flexible duplex plug to protect conventional duplex electrical outlets. The protector includes a pair of dielectric cap means connected by an S-shaped tether formed of a flexible non-conductive material. Prongs projecting from the rear of the dielectric caps simulate the prongs of a standard electrical appliance plug, so that they may be easily and removably received by the receptacle of an electrical outlet.

The tether has an aperture located between the dielectric cap means, for attachment to a duplex electric outlet by a screw. The length of the S-shaped tether attached to an electrical outlet is adapted to permit biasing of one or both dielectric cap means laterally away from the outlet, while either the second plug is engaged or its prongs in the outlet or the tether remains attached to the outlet, thereby permitting exposure and unobstructed access to a receptacle. Each dielectric cap and its tether is sufficiently resilient to permit the repeated biasing of the cap means and the tether back and forth.

BRIEF DESCRIPTION OF THE DRAWINGS

A better understanding of the present invention, together with other and further objects and advantages of the invention, will be apparent from an examination of the following description and drawings, wherein a preferred embodiment of the invention is depicted.

DETAILED DESCRIPTION OF INVENTION

Figure 1:
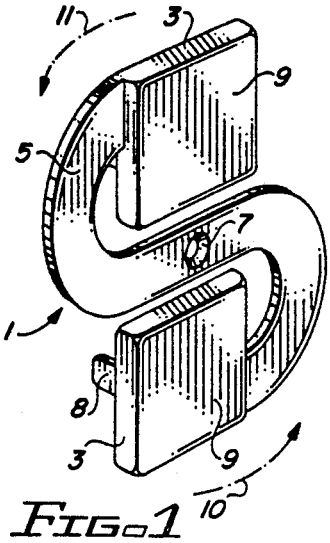
FIG. 1 illustrates a front perspective view.
Figure 2:
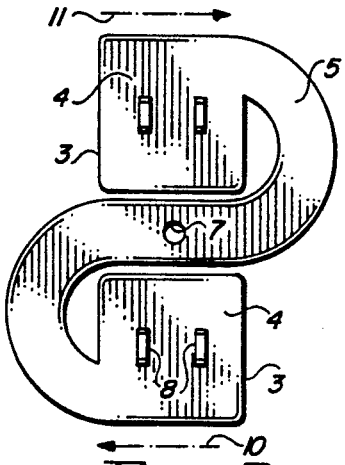
FIG. 2 is a rear plain view of the device of FIG. 1.
Figure 3:
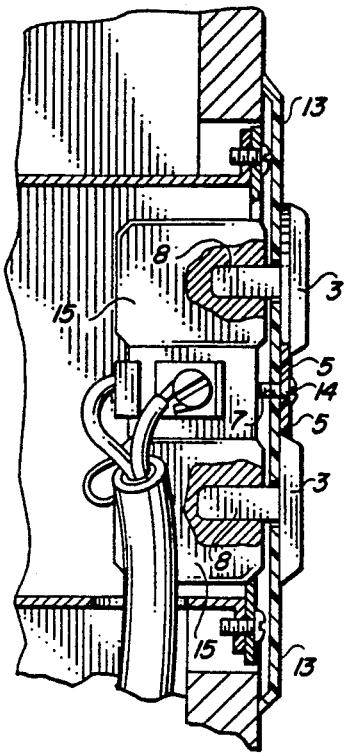
FIG. 3 is a side elevation View of the device of FIG. 1 plugged in to a duplex electrical outlet.
Figure 4:
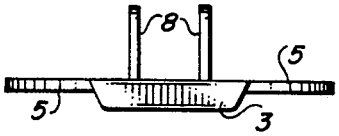
FIG. 4 is an end elevation view of the device.

A flexible Plug Protector 1 made in accordance with the present invention is shown in FIG. 1. The protector includes a pair of plugs each having dielectric cap means 3 and connected by a generally S-shaped tether means 5. Extending from the rear surface 4 of each dielectric cap means 3 are prong means 8. The prongs, located centrally of the related cap means 3, are spaced from each other and are adapted to be removably received in a standard electrical outlet receptacle 15 as illustrated in FIGS. 5 and 6.

The generally S-shaped tether means 5 is provided with an aperture 7 for detachably securing the tether to the center mounting hole of a duplex electrical outlet by a mounting screw 14. The generally S-shaped tether means 5 attached to said duplex electrical outlet is adapted to permit biasing of one or both dielectric cap means 3 laterally away from the outlet in the direction of the arrows 10, 11, (that is to say, to the left or right of the plug) while the tether remains attached to the outlet. Optionally, the tether may be free of the center mount, i.e. screw 14 so not utilized, but the one plug is engaged in its associated outlet. Both means permit the unemployed plug to be biased away to the side of the outlet where it does not obstruct the use of the other outlet. In that case the mounting screw 14 does not engage the aperture 7 and the tether 5 is merely placed over the screw 14 which is in place to retain the decorative cover 13. To prevent insertion of fingers or objects in a receptacle of an electrical outlet, pressure is applied to the front surface 9 of the dielectric cap means 3 forcing the projecting prongs 8 into the openings of a correspondingly aligned electrical outlet receptacle 15.

Figure 5:
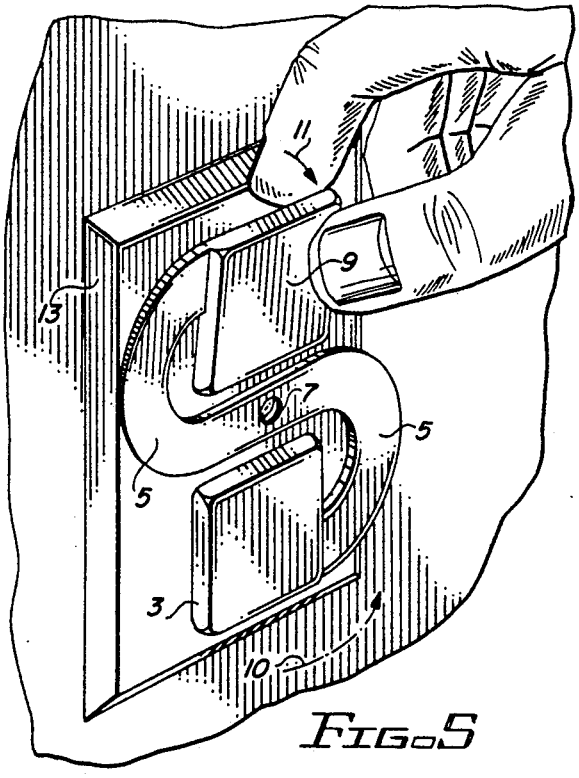
FIG. 5 is a front perspective view of the device of FIG. 1.
Figure 6:
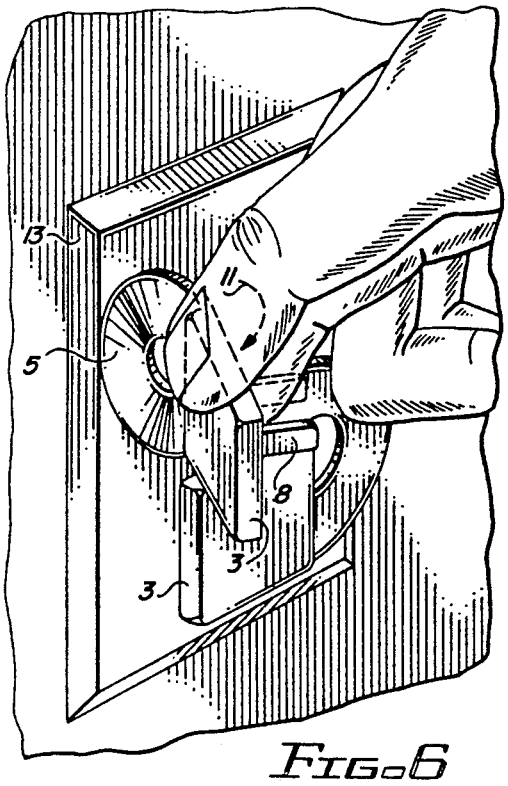
FIG. 6 is the front perspective view of FIG. 5, showing a dielectric cap means biased away from the duplex electrical outlet.

One or both receptacles of a protected electrical outlet may be exposed by withdrawing the prong means 8 of corresponding dielectric cap means 3 from the electrical outlet receptacle 15 as shown in FIG. 5 and then biasing the dielectric cap means 3 laterally away from electrical outlet the receptacle 15 as shown in FIG. 6.

While a specific embodiment of the invention has been shown and described, it will be obvious to those very skilled in the art that various changes and modifications may be made therein, without departing from the scope, spirit and intent of the invention as set forth in the appended claims.

What is claimed is:

1. A flexible duplex plug for protecting duplex electrical outlets having a center mounting hole for a cover, comprising:

dielectric cap means, prong means projecting from said cap means and adapted to be removably received in said outlets, a flexible, generally S-shaped tether means connecting said cap means, the length of said tether adapted to permit biasing of said caps laterally away from said outlet.

2. A flexible duplex plug as defined in claim 1, wherein said tether means further comprises means defining an aperture in said tether means for detachably securing same to the center mounting hole of said duplex electrical outlet by a mounting screw.

3. A flexible plug as defined in claim 1, wherein said dielectric cap means are planar.

* * * * *